US006779426B1

(12) United States Patent
Holliday

(10) Patent No.: US 6,779,426 B1
(45) Date of Patent: Aug. 24, 2004

(54) DIE RULE RETENTION DEVICE AND RETAINING BOARD INCORPORATING SAME

(75) Inventor: Brightman Kenneth Holliday, Conyers, GA (US)

(73) Assignee: Atlas Die LLC, Elkhart, IN (US)

( * ) Notice: Subject to any disclaimer, the term of this patent is extended or adjusted under 35 U.S.C. 154(b) by 217 days.

(21) Appl. No.: 09/745,016

(22) Filed: Dec. 21, 2000

Related U.S. Application Data

(60) Provisional application No. 60/172,921, filed on Dec. 21, 1999.

(51) Int. Cl.[7] ..... B26F 1/46; B21K 5/20

(52) U.S. Cl. ..... 83/13; 83/652; 83/698.21; 83/699.11; 76/107.8

(58) Field of Search ..... 83/698.21, 699.11, 83/652, 655, 531, 55, 686; 76/107.8

(56) References Cited

U.S. PATENT DOCUMENTS

| | | | | | |
|---|---|---|---|---|---|
| 969,371 | A | * | 9/1910 | Helm | 83/658 |
| 1,766,244 | A | | 6/1930 | Cumfer | |
| 2,821,871 | A | | 2/1958 | Sarno | |
| 3,036,478 | A | | 5/1962 | Scott et al. | |
| 3,089,376 | A | * | 5/1963 | Whistler et al. | 335/285 |
| 3,115,805 | A | | 12/1963 | Engelmann | |
| 3,253,493 | A | * | 5/1966 | Weisbeck | 30/358 |
| 3,256,043 | A | | 6/1966 | Krekeler | |
| 3,256,753 | A | | 6/1966 | Dasse et al. | |
| 3,461,755 | A | | 8/1969 | Gerew et al. | |
| 3,527,123 | A | | 9/1970 | Dovey | |
| 3,530,750 | A | | 9/1970 | Daniels | |
| 3,570,345 | A | * | 3/1971 | Spengler | 76/107.8 |
| 3,747,452 | A | | 7/1973 | Gilev et al. | |
| 3,782,166 | A | | 1/1974 | Whistler, Jr. et al. | |
| 3,826,170 | A | | 7/1974 | Jones et al. | |
| 3,835,746 | A | | 9/1974 | Young, Jr. et al. | |
| 3,863,550 | A | | 2/1975 | Sarka et al. | |
| 3,884,132 | A | | 5/1975 | Snodgrass | |
| 3,941,038 | A | * | 3/1976 | Bishop | 493/371 |
| 3,965,786 | A | | 6/1976 | D'Luhy | |
| 3,998,669 | A | | 12/1976 | Strnat | |
| 4,052,886 | A | | 10/1977 | Buick | |
| 4,195,542 | A | * | 4/1980 | Zimmer | 403/DIG. 1 |
| 4,210,047 | A | | 7/1980 | Haas et al. | |
| 4,223,684 | A | * | 9/1980 | Boogers et al. | 83/76.8 |

(List continued on next page.)

FOREIGN PATENT DOCUMENTS

CA 2035928 8/1997

OTHER PUBLICATIONS

Master Magnetics, Inc., "*Rare Earth Magnets*" publication, Aug. 11, 1999 http://www.mastermagnetics.thomasregister.com/olc/mastermagnetics/properti.htn.

*Primary Examiner*—Allan N. Shoap
*Assistant Examiner*—Jason Prone
(74) *Attorney, Agent, or Firm*—Kilyk & Bowersox, P.L.L.C.

(57) ABSTRACT

An apparatus is provided for improved retention of magnetically attractable die rules inserted into slots of a retaining board. In a die rule retaining board, a plurality of chambers are oriented substantially perpendicular to a die slot and the direction of insertion of a die rule into the retaining board. In one embodiment, each of the chambers has an open face to permit communication between the chamber and a die slot in the retaining board. A magnetic die rule retention device is located within each chamber and includes a contact face intended to contact and retain a magnetically attractable die rule inserted into a respective die slot. Once the die rule is completely inserted into the die rule slot, the contact face of the magnetic retention device exerts an attractive force against the die rule in the direction of the retention device slot and securely holds the die rule within the die slot.

19 Claims, 2 Drawing Sheets

U.S. PATENT DOCUMENTS 4,233,873 A 11/1980 Jessen
4,360,168 A 11/1982 Peterson, Jr.
4,476,762 A * 10/1984 Anderson et al. ..... 83/699.31
4,544,820 A 10/1985 Johnson
4,726,270 A 2/1988 Lucas
4,792,367 A 12/1988 Lee
4,848,202 A 7/1989 Crampton
4,914,996 A 4/1990 Lavorel
4,923,350 A 5/1990 Hinksman et al.
5,001,950 A 3/1991 Fokos et al.
5,029,505 A 7/1991 Holliday
5,094,134 A * 3/1992 Mizukoshi ..... 33/18.1
5,138,919 A * 8/1992 Wilhelm ..... 83/139
5,138,923 A 8/1992 Kent et al.
5,178,051 A 1/1993 Smith et al.
5,230,271 A * 7/1993 Hardisty et al. ..... 101/226
5,275,076 A * 1/1994 Greenwalt ..... 403/357
5,379,671 A 1/1995 Kang
5,388,490 A 2/1995 Buck
5,505,109 A 4/1996 Okonski et al.
5,536,334 A 7/1996 Kobayashi et al.
5,538,565 A 7/1996 Akioka et al.
5,555,786 A 9/1996 Fuller
5,560,784 A 10/1996 Akioka et al.
5,565,043 A 10/1996 Akioka et al.
5,566,594 A 10/1996 Michlin
5,597,425 A 1/1997 Akioka et al.
5,636,428 A 6/1997 Van Mourik
5,697,277 A 12/1997 Okonski et al.
5,789,050 A 8/1998 Kang
5,888,416 A 3/1999 Ikuma et al.
5,937,722 A * 8/1999 Albright ..... 83/498
6,196,095 B1 * 3/2001 Suter ..... 83/613
6,209,436 B1 * 4/2001 Smithwick ..... 83/698.11
6,481,323 B1 * 11/2002 Beerhalter ..... 83/687
6,523,448 B1 * 2/2003 Chang ..... 83/699.11

* cited by examiner

FIG. 4
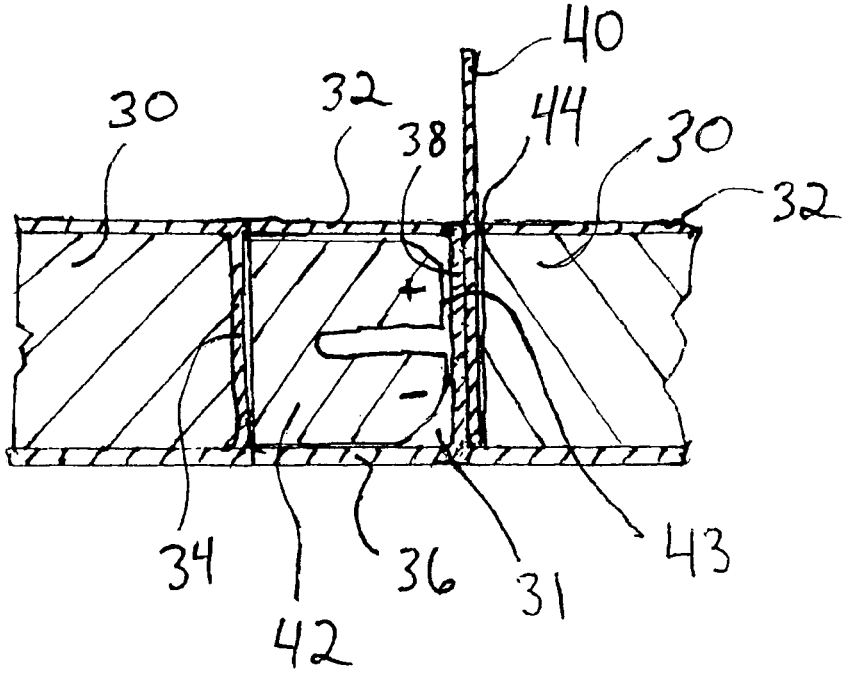
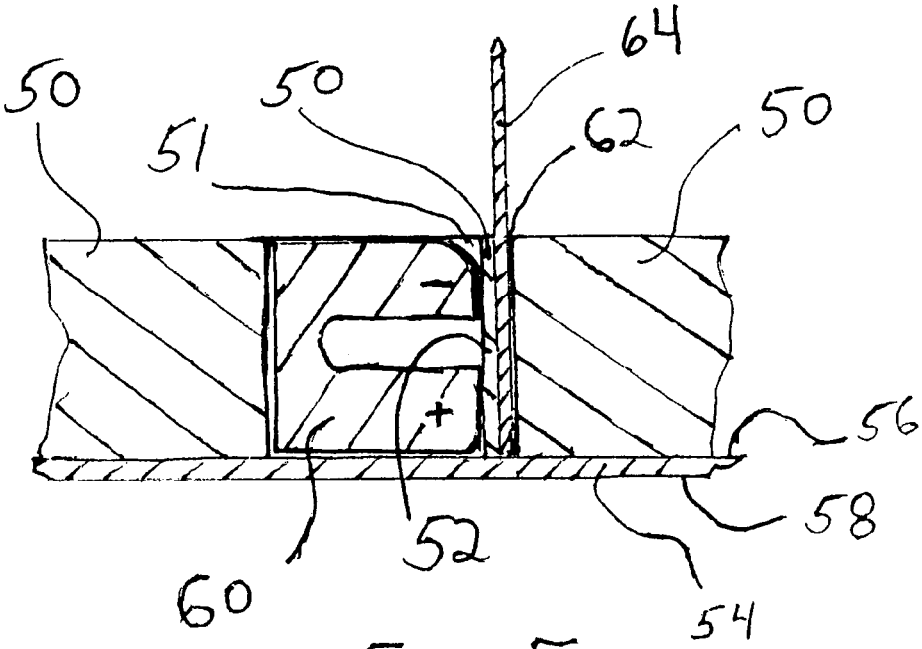
FIG. 5

DIE RULE RETENTION DEVICE AND RETAINING BOARD INCORPORATING SAME

CROSS REFERENCE TO RELATED APPLICATION

This application claims the benefit under 35 U.S.C. § 119(e) of prior U.S. Provisional Application No. 60/172,921 filed Dec. 21, 1999, which is incorporated in its entirety by reference herein.

BACKGROUND OF THE INVENTION

The present invention relates generally to die rule holders and more particularly to die rule retaining boards having incorporated therein a die rule retention device.

Steel rule dies are widely used to cut a variety of materials such as cardboard and plastics into a desired shape. Often, the steel rule dies are pressure inserted into slots located in a retaining board made of wood or other suitable material. During the operation of a cutter, the dies often become loosened and ultimately disengaged, thereby necessitating costly and time consuming interruption of the cutting process when repairs are undertaken. In addition, the slots are of varying widths to accommodate dies of varying widths, thus making standardization difficult.

Several attempts have been made to prevent this loosening of steel rule dies. For example, U.S. Pat. No. 4,052,886 discloses a solid base material having caverns which are filled with semi-rigid filler material to anchor an inserted steel die. However, this method requires time-consuming filling of the semi-rigid filler material and the ultimate strength of securing the rule is dependent on the filler material selected.

U.S. Pat. No. 3,941,038 discloses the use of S-wall shaped resilient members which pin a die rule between the resilient members and packing shims. This apparatus necessitates a difficult insertion of the rule between the resilient member and the shims.

Another proposal is shown in U.S. Pat. No. 3,835,746. A resilient support and spring are deformed upon insertion of a die into a die slot and thereafter exert an upward force against the die to secure it in a slot. Such a deformation ultimately leads to mechanical failure of the retaining system as the die is continuously displaced.

Accordingly, it is an object of the present invention to provide an apparatus which securely retains die rules in a retaining board.

It is a further object of the present invention to accomplish the foregoing object without difficult insertion of the die rule.

It is yet another object of the present invention to accomplish the proceeding objects simply and economically.

It is a still further object of the present invention to achieve the foregoing objects with an apparatus that is durable and long lasting.

It is another object of the present invention to achieve the above objects for steel rule dies of varying widths.

Other objects and advantages of the present invention will be apparent from the specification and drawings which follow.

SUMMARY OF THE INVENTION

The foregoing and additional objects are obtained by an apparatus according to the present invention for securing die rules inserted in associated die slots in a die rule retaining board. The apparatus includes at least one chamber located adjacent to each slot and having an open face opening towards the slot. The chamber is oriented substantially perpendicular to the direction of insertion of the die rule. Magnetic retention means, for example, a permanent magnet, is provided in each chamber for urging the inserted die normally towards the retention device. Accordingly, a magnetically attractable die can be securely yet removably held within the die slot upon insertion into the slot due to the magnetic attraction between the retention device and the die rule.

BRIEF DESCRIPTION OF THE DRAWINGS

FIG. 4 is an exposed view of a die holder according to another embodiment of the present invention taken along a cross-sectional line similar to line 2—2 of FIG. 1; and FIG. 5 is an exposed view of yet another embodiment of the present invention taken along a cross-sectional line similar to line 2—2 of FIG. 1.

DETAILED DESCRIPTION OF THE INVENTION

The present invention will now be described in greater detail with reference to the accompanying drawings.

Figure 1:
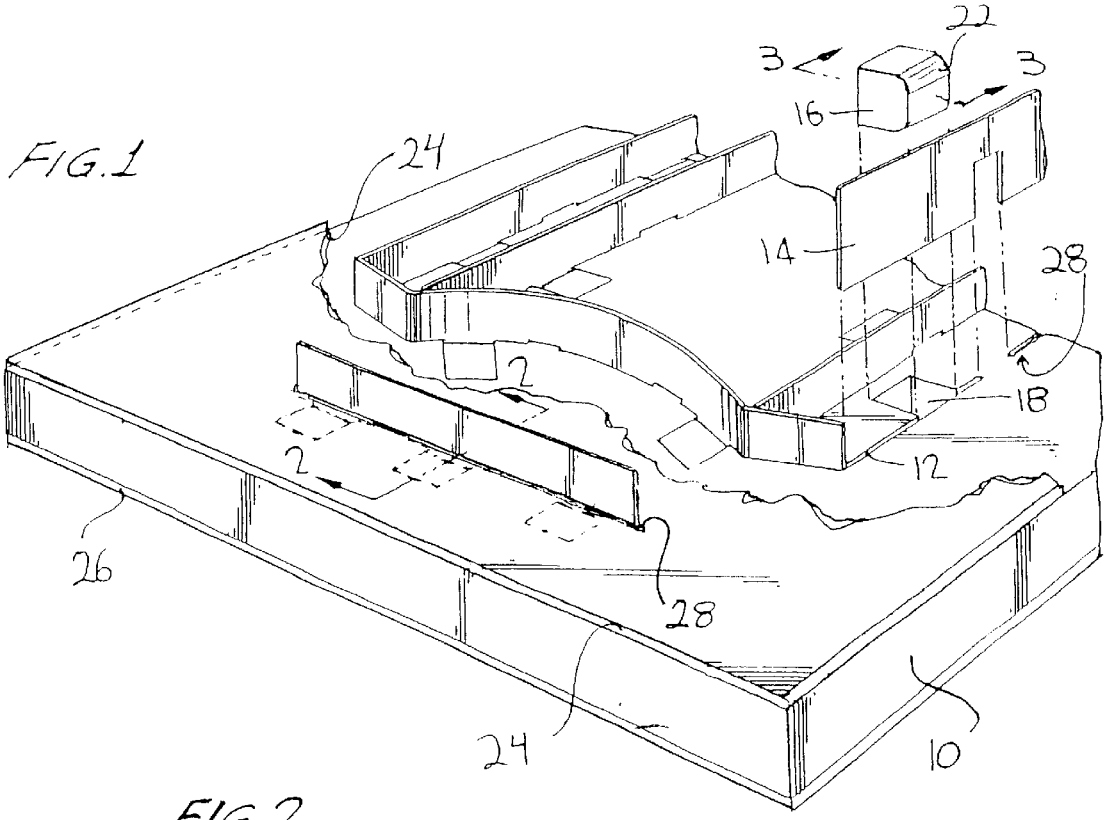
FIG. 1 is a plan view of the steel rule die holder according to the present invention shown in its working environment.

Referring to FIG. 1, a retaining board 10 composed of wood, plastic, or other suitable material is provided with a plurality of die slots 12. The die slots 12 may be formed by any conventional apparatus such as laser beams or jig saws. Die rules 14, such as steel rule dies, are provided which have a width that is slightly less than the width of an associated slot. Accordingly, the die rules 14 may be inserted into an associated die slot 12. Preferably, the die rules fit snugly within the die slots, but can be removed, preferably easily, in the absence of the magnetic retention means. Of course, the die rule must be magnetically attracted to the magnetic retention means and preferably will comprise at least one of iron, steel, cobalt, nickel, manganese, chromium, and copper. Steel is a preferred material for the die rule, particularly stainless steel.

To prevent the inserted die 14 from loosening or being loose within the die slot 12, an apparatus according to the present invention is provided. At least one substantially cubed shaped magnetic retention device 16 is provided within a retention device slot 18 adjacent to the die slots 12. The retention means is/are preferably arranged in a predetermined fashion to ensure a good retention strength or holding force. In the embodiment shown, slots 18 are in communication with slots 12 via an open face. As will be apparent to one skilled in the art from the present application, the number and locations of the retention devices 16 and the associated elements described below is determined by considering such factors as optimum securing of the inserted dies and manufacturing costs.

The magnetic retention means may comprise a permanent magnet or an electromagnet. Preferably, the magnetic retention means comprises a permanent magnet. The magnetic retention means may be of any suitable shape and size. Substantially cubed shaped permanent magnets, horseshoe or U-shaped magnets, and rod-shaped magnets are preferred for the magnetic retention means. Preferably, the magnetic retention means includes one or more flat surface that contacts the die rule, and preferably the flat surface has a height dimension from top to bottom that is from 0.5 to 2.0 times its width dimension. The width dimension is in the direction of elongation of the die rule. Preferably, the width of the flat surface is about equal to its height. The magnetic retention means also has a depth that extends perpendicularly in relation to the height and width of its flat surface, away from the die rule. The depth dimension may preferably be from about 0.5 to about 2.0 times the width dimension of the flat surface.

To achieve a substantial holding force, the magnetic retention means preferably comprises a very strong magnetic material, such as a rare earth magnet. According to the present invention, rare earth magnets are preferred for the magnetic retention means because they are extremely strong for their small size. Examples of preferred rare earth magnetic materials for magnetic retention devices useful as the retention means include materials made of rare earth metals, for example, the rare earth magnets available from THE MAGNET SOURCE™ via Master Magnetics, Inc., of Castlerock, Colo.; from A-L-L Magnetics, Inc., of Placentia, Calif.; and from Miami Magnet Co., of Miami, Fla. Particular rare earth magnets that are preferred according to the present invention include those made from the following materials, all available from THE MAGNET SOURCE™: SmCo 18, SmCo 20, SmCo 24, SmCo 26, Neodymium 27, Neodymium 27H, Neodymium 30, Neodymium 30H, and Neodymium 35. In particular, neodymium magnets comprised of neodymium, iron, boron, and a few transition metals represent a preferred class of magnetic materials useful for the magnetic retention devices of the present invention. Samarium cobalt magnets are also preferred and comprise samarium, cobalt, and iron. Such neodymium magnets and samarium cobalt magnets are available from THE MAGNET SOURCE™.

The magnetic retention devices can be cut or machined from larger magnet shapes such as blocks and disks. The magnetic retention devices may include tapered top edges 22, as shown in FIGS. 2 and 3, to facilitate insertion of a die rule in an associated die slot.

Any suitable means of securing the magnetic retention device within the retention device slot may be used. According to the embodiment shown in FIG. 1, the present invention may include an upper and lower retaining sheet 24 and 26, respectively. The retaining sheets may comprise a thermoplastic material, for example, a reinforced thermoplastic. Resinous materials may be used for the retaining sheets, for example, phenolic resins which include reinforcing graphite fibers. Lamellar thermoplastic sheet materials may also be used for the retaining sheets 24 and 26.

The retaining sheets 24 and 26 are secured to the top and bottom surfaces of the retaining board 10 and prevent the magnetic retention devices 16 from falling out of or through the retention device slots 18. The top and bottom retention sheets 24 and 26 can be secured to the retaining board 10 by any suitable means including adhesive means, clamp means, fastening means such as screws, nails, rivets, and velcro, and the like. According to a preferred embodiment of the invention, the retaining sheets 24 and 26 each comprise a phenolic resin material.

Figure 2:
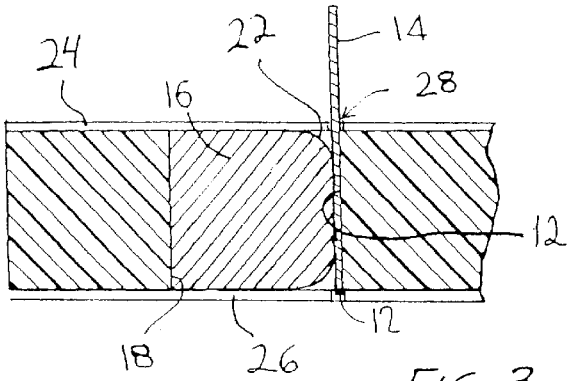
FIG. 2 is an exposed view of the die holder of the present invention taken along line 2—2 of FIG. 1.
Figure 3:
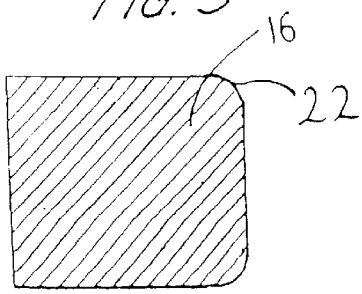
FIG. 3 is an exposed view of the present invention taken along line 3—3 of FIG. 1.

At least the top retaining sheet 24 is provided with slots 28 therein as shown in FIG. 2. The slots 28 line-up with and correspond to the die slots 12 in the retaining board 10 such that a die rule can be inserted through slots 28 in retaining sheet 24 and into die slots 12 in the retaining board 10. Corresponding slots may also be provided in the bottom retaining sheets 26, particularly for applications wherein when the die rule is fully inserted into the die slot it extends completely through the die slot 12.

In operation, when a magnetically attractable die rule is inserted into an associated slot 12, a magnetic attractive force is generated between the die rule and the magnetic retention device. Preferably, the magnetic retention device is snugly fit within its corresponding retention device slot 18 formed in the retaining board 10. Preferably, there is little to no movement of the magnetic retention device within the retention device slot upon insertion and/or removal of a die rule from the die slot. Because the width of die rules may vary, it is preferable to provide a slight spacing between the die rule and the vertical walls of the die slot. Although one would expect the die rule to be loose in the die slot if a snug fit is not provided, it has been found that the magnetic retention devices of the present invention adequately hold the die rule in the die slot without any movement of the die rule therein. Because of the magnetically attractive force of the magnetic retention device, the die rule is preferably urged toward the vertical die slot wall adjacent the retention device slot, that is, toward the same side of the die slot as the retention device slot.

Despite the strong holding strength obtained by the magnetic retention devices of the present invention, a magnetically attractable die rule can still be removed from the die slot for replacement, sharpening, or the like. Upon removal of the die rule from the die slot, the magnetic retention device remains in the retention device slot by way of a retention mechanism, for example, the retaining sheets 24 and 26 discussed above.

According to some embodiments of the present invention, the retention device slot does not have an open face but instead is adjacent, yet separated from, the die slot. An integrally formed or separately added dividing wall can be provided between the die slot and the retention device slot, for example, to provide a continuous wall defining, in part, the die slot.

FIGS. 4 and 5 show two embodiments wherein the retention device slot is adjacent, but not in communication with, the die slot. In FIG. 4, a device according to the present invention is provided wherein a retaining board 30 contains therein a retention device slot 31 and a die slot 44. A steel rule die 40 occupies the die slot 44. A horseshoe magnet 42 occupies the retention device slot 31 and includes a flat face 43 that faces the inserted steel rule die 40. A phenolic resin retaining or covering material is provided and comprises a top plate 32, and bottom plate 36, and vertical dividing walls 34 and 38. Vertical wall 38 separates the retention device slot 31 from the die slot 44 so that in the embodiment of FIG. 4 there is no opening from the retention device slot into the die slot. According to the embodiment shown, the die rule 40 never comes into direct contact with horseshoe magnet 42 during insertion, retention or removal of the die rule from the die slot.

FIG. 5 shows yet another embodiment of the present invention wherein a retaining board 50 has formed therein a retention device slot 51 and a die slot 62 that are adjacent, yet separated from each other. As can be seen from FIG. 5, the retaining board 50 includes a thin vertical wall 52 that forms a barrier between the die slot 62 and the retention device slot 51. A horseshoe magnet 60 is provided within the retention device slot and has flat surfaces that face the die rule 64. A phenolic retention plate 54 is provided on the bottom of the retention board 50 to prevent the horseshoe magnet 60 and the die rule 64 from passing through the retaining board 50. The retention plate 54 has a top surface 56 that contacts the die rule and magnet, and a bottom surface 58. The retention plate 54 may contain or be coated with magnet particles or a magnetic film to magnetically attract the magnet retention device and retain the device in the retention device slot. In the embodiment shown in FIG. 5, the top surface 56 of retention plate 54 would preferably be negatively charged so as to attract the positive arm of horseshoe magnet 60 and retain the magnet within the retention device slot 51.

In the embodiments shown in FIGS. 4 and 5, the vertical separating walls 38 and 52 are preferably of sufficient thinness so as not to substantially interfere with the magnetic attraction between the retention device and the die rule. Separating walls of different materials may also be used including materials such as polytetrafluoroethylene and polyethyleneterephthalate.

According to embodiments wherein the magnetic retention device is an electromagnet, the wires for supplying a source of electricity to the device can be integrally formed in the retaining board, or mounted on the board in a safe location, for example, to the underside of the retaining board. A suitable electric source is also provided.

The present invention thus prevents down time associated with loose dies. The described apparatus securely holds the dies in a simple, efficient, and economic manner. Also, the magnetic retention devices are very durable, have a long useful lifetime, and can secure dies of varying widths in the slots.

Other embodiments of the present invention will be apparent to those skilled in the art from consideration of the specification and practice of the invention disclosed herein. It is intended that the specification be considered as exemplary only, with a true scope and spirit of the present invention being indicated by the following claims.

What is claimed is:

1. An apparatus for securing a magnetically attractable die inserted in a die slot of a retaining board, comprising:

at least one retention device slot located adjacent to the die slot, said retention device slot having a dimension extending towards the die slot wherein said retention device slot has an open face opening towards and being continuous with the die slot, and said die slot having a first wall and an opposite second wall; and at least one magnetic retention device for urging the inserted die normally towards the first wall of the die slot, wherein said magnetic retention device is positioned within the retention device slot and extends toward the die slot;

whereby the die is securely held within the die slot upon insertion of said die when said magnetic retention means is in said retention device slot.

2. The apparatus of claim 1, wherein said retention device slot is oriented substantially perpendicular to a direction of insertion of the die.

3. The apparatus of claim 1, wherein said magnetic retention device is substantially cube-shaped.

4. The apparatus of claim 1, wherein said magnetic retention device comprises a permanent magnet.

5. The apparatus of claim 1, wherein said magnetic retention device comprises a rare earth magnet.

6. The apparatus of claim 1, wherein said magnetic retention device comprises a neodynium magnet.

7. The apparatus of claim 6, wherein said magnetic retention device comprises a magnetic material that includes neodymium, iron, and boron.

8. The apparatus of claim 1, wherein said magnetic retention device comprises a samarium cobalt magnet.

9. The apparatus of claim 8, wherein said magnetic retention device comprises a magnetic material that includes samarium, cobalt, and iron.

10. A method of securing a die within a die slot located within a retaining board, comprising the steps of:

providing a die rule retention device that provides a magnetic force;

inserting said device into a retention device slot adjacent to the die slot such that the retention device extends from the retention device slot toward the die slot wherein said retention device slot has an open face opening towards the die slot, and wherein said die slot includes a first wall and an opposite second wall, and the retention device slot is formed along the first wall;

inserting the die into the die slot; and applying a magnetic force to the inserted die which is substantially normal to the direction of insertion, by the die rule retention device, whereby the inserted die is forced toward the first wall and secured within the die slot.

11. The method of claim 10, further comprising the step of removing said die from said die slot and providing means to retain said die rule retention device in said retention device slot upon removal of said die.

12. The method of claim 10, wherein said die rule retention device is substantially cube-shaped.

13. The method of claim 10, wherein said die rule retention device comprises a permanent magnet.

14. The method of claim 10, wherein said die rule retention device comprises a rare earth magnet.

15. The method of claim 10, wherein said die rule retention device comprises a neodyrnium magnet.

16. The method of claim 10, wherein said die rule retention device comprises a samarium cobalt magnet.

17. The method of claim 10, wherein said die rule retention device fits snugly within said retention device slot.

18. The method of claim 10, wherein said die rule retention device comprises an electromagnet.

19. The method of claim 10, wherein said die rule retention device comprises a horseshoe magnet.

* * * * *